US005755871A

United States Patent [19]

Husson, Sr.

[11] Patent Number: 5,755,871

[45] Date of Patent: May 26, 1998

[54] HIGH BRIGHTNESS PAPER COATING FORMULATIONS

[76] Inventor: Thomas E. Husson, Sr., 1403 Coventry Ct., Woodstock, Ga. 30188

[21] Appl. No.: 589,710

[22] Filed: Jan. 22, 1996

[51] Int. Cl.[6] ..... C09D 1/00

[52] U.S. Cl. ..... 106/487; 106/157.71; 106/217.01; 106/217.3; 106/159.1; 106/145.1; 106/445; 106/241; 428/357; 428/537.5; 162/181.1

[58] Field of Search ..... 106/487, 241, 106/157.71, 217.01, 217.3, 159.1, 145.1, 445; 428/537.5, 357; 162/181.1

[56] References Cited

U.S. PATENT DOCUMENTS

| | | | |
|---|---|---|---|
| 3,594,203 | 7/1971 | Sawyer, Jr. et al. | 106/487 |
| 4,117,191 | 9/1978 | Kurrle | 428/330 |
| 4,820,554 | 4/1989 | Jones et al. | 427/391 |
| 4,826,536 | 5/1989 | Raythata et al. | 106/465 |
| 4,851,048 | 7/1989 | Jones et al. | 106/446 |
| 5,207,822 | 5/1993 | Manasso et al. | 106/416 |
| 5,298,066 | 3/1994 | Shurling, Jr. et al. | 106/487 |
| 5,336,311 | 8/1994 | Curtis et al. | 106/416 |
| 5,458,680 | 10/1995 | Shurling, Jr. et al. | 106/487 |

FOREIGN PATENT DOCUMENTS

WO 89/08739 9/1989 WIPO .

OTHER PUBLICATIONS

Hollingsworth, et al., *The Effect of Calcined Clays on the Printability of coated Rotogravure and Offset Printing Papers*, 1983 Coating Conference, TAPPI Proceedings (no month).

*Primary Examiner*—Michael Marcheschi

*Attorney, Agent, or Firm*—Needle & Rosenberg, P.C.

[57] ABSTRACT

A high brightness coating composition made from a pigment made of a major pigment portion of a hydrous kaolin having a TAPPI brightness of at least about 85 and a minor pigment portion of a calcined kaolin, and a binder, where the pigment is substantially free of titanium dioxide. A high brightness coating composition made from a pigment made from a major pigment portion of a hydrous kaolin having a TAPPI brightness of at least about 85 and a minor pigment portion made from a calcined kaolin and titanium dioxide, and a binder, wherein titanium dioxide makes up less than about 15 dry parts per hundred of the pigment. A method of using a coating composition to coat a low brightness substrate such as basestock, where the resultant coated substrate has a TAPPI brightness of at least about 75, by coating the substrate with from about 1 to about 5 lbs./msf of a coating composition of the invention and, optionally, coating the substrate with a second coating of at least about 2 lbs./msf of the coating composition. A coated paper product having a TAPPI brightness of at least about 75 comprising a substrate coated with a first coating of from 1 to 5 lbs./msf of a coating composition of the invention and, optionally, a second coating of at least about 2 lbs./msf of the coating composition disposed over the first coating weight.

40 Claims, No Drawings

HIGH BRIGHTNESS PAPER COATING FORMULATIONS

BACKGROUND

1. Field of the Invention

The present invention relates to high brightness paper coating formulations. More particularly, the present invention relates to high brightness paper coating formulations combining a major portion of hydrous and a minor portion of calcined clay and significantly reducing or eliminating the need for titanium dioxide.

2. Background of the Invention

Kaolin or "China Clay" is a hydrous aluminum silicate used in the paper industry in pigments and as a filler. Hydrous kaolin is white, relatively inert and is of a fine particle size. Kaolin is made up principally of clay mineral kaolinite. The kaolin may also contain small amounts of other minerals, as well as impurities. Technically, it is not correct to speak of this type of clay as "hydrous" because there is no molecular water in the kaolinite structure. Instead, the composition is an aluminum hydroxide silicate having the approximate formula $Al_2(OH)_4Si_2O_5$. However, for ease of reference, this clay will be referred to as "hydrous" kaolin throughout this application.

Kaolin is often subjected to a benefication process consisting of fractionating the kaolin in a continuous centrifuge to a controlled particle size. Next the kaolin is bleached to remove iron-based colored compounds. Bleaching often occurs via acidification with sulfuric acid to a pH of about 3.0. Then sodium hydrosulfite is added to reduce the iron to its more soluble ferrous form which is removed during a dewatering process. The flocculated clay of approximately 30% solids by weight is then filtered or dewatered on a rotary vacuum filter to a solids level of approximately 60% by weight. To produce high brightness kaolin, i.e., brightness indices or values greater than 90 as measured by TAPPI procedure T-646-os-75 (hereinafter referred to "TAPPI brightness"), impurities may be removed by further processing through flotation or magnetic separation.

In addition, a delaminated kaolin may be produced by grinding the course fraction from the centrifugation in sand grinders to shear the stacks of platelets normally found in kaolin, thereby producing particles having an equivalent spherical diameter (E.S.D.) of less than 2 microns.

Calcined kaolin is an anhydrous kaolin produced by subjecting hydrous kaolin to temperatures of at least 450° C. and often up to 1050° C. At these temperatures the structural hydroxyl groups are driven out as water vapor. The resulting calcined clay has an amorphous structure comprising voids and interfaces between kaolin and air. The interfaces serve as sites for light scattering. Calcined clay, therefore, has preferable optical efficiency compared to uncalcined, hydrous kaolin.

In addition to kaolin pigments, the paper industry has used other opacifying agents to improve the quality of the resulting paper. Because it has a high refractive index ("RI"), titanium dioxide is a common opacifying agent in the paper industry. The two common forms of titanium dioxide, rutile and anatase, have RIs of 2.7 and 2.55, respectively. The major disadvantage of the use of titanium dioxide is its cost.

Therefore, there exists a need for a coating formulation and application method whereby the use of titanium dioxide is reduced or eliminated, while the brightness of the coated substrate is at least about 75 on the TAPPI scale regardless of the brightness of the original substrate.

SUMMARY OF THE INVENTION

The present invention provides a basic coating formulation that reduces or eliminates the need for titanium dioxide and is useful for coating dark substrates and providing brightness values above about 75 TAPPI brightness and preferably above about 78 TAPPI brightness.

In particular, the present invention provides a high brightness coating composition, comprising a pigment comprising a major pigment portion of a hydrous kaolin having a TAPPI brightness of at least about 85 and a minor pigment portion of a calcined kaolin, and a binder, wherein the composition is substantially free of titanium dioxide.

In addition, the present invention provides a high brightness coating composition, comprising a pigment comprising a major pigment portion of a hydrous kaolin having a TAPPI brightness of at least about 85 and a minor pigment portion comprising a calcined kaolin and titanium dioxide, and a binder, wherein the titanium dioxide is less than about 15, preferably less than about 10, dry parts per hundred of the pigment.

Moreover, the present invention also provides a method of using a coating composition to coat a low brightness substrate, whereby the resultant coated substrate has a TAPPI brightness of at least about 75, the method comprising coating the substrate with a first coating weight of from about 1 to about 5 pounds per 1000 square feet ("lbs./msf") of a coating composition comprising a pigment comprising a major pigment portion of a hydrous kaolin having a TAPPI brightness of at least about 85, and a minor pigment portion of a calcined kaolin and a binder, wherein the coating composition is substantially free of titanium dioxide, and, if necessary, coating the substrate with a second coating weight of at least about 2 lbs./msf of the coating composition.

In addition, the present invention also provides a method of using a coating composition to coat a low brightness substrate, whereby the resultant coated substrate has a TAPPI brightness of at least about 75, the method comprising coating the substrate with a first coating weight of from about 1 to about 5 lbs./msf of a coating composition comprising a pigment comprising a major pigment portion of a hydrous kaolin having a TAPPI brightness of at least about 85, and a minor pigment portion comprising a calcined kaolin and titanium dioxide, and a binder, wherein the titanium dioxide is less than about 15 dry parts per hundred of the pigment and, if necessary, coating the substrate with a second coating weight of at least about 2 lbs./msf of the coating composition.

In yet another embodiment, the present invention provides a coated paper product having a TAPPI brightness of at least about 75 comprising a substrate coated with a first coating weight of from about 1 to about 5 lbs./msf of a coating composition comprising a pigment comprising a major pigment portion of a hydrous kaolin having a TAPPI brightness of at least about 85, and a minor pigment portion of a calcined kaolin, and a binder, wherein the coating composition is substantially free of titanium dioxide. In a preferable embodiment, the coated paper product further comprises, if necessary, a second coating weight of at least about 2 lbs./msf of the coating composition disposed over the fist coating weight.

In addition, the present invention provides a coated paper product having a TAPPI brightness of at least about 75 comprising a substrate coated with a first coating weight of from about 1 to about 5 lbs./msf of a coating composition comprising a pigment comprising a major pigment portion of a hydrous kaolin having a TAPPI brightness of at least about 85, and a minor pigment portion comprising a calcined kaolin and titanium dioxide, and a binder, wherein the titanium dioxide is less than about 15 dry parts per hundred of the pigment. In a preferred embodiment, the coated paper product further comprises a second coating weight of at least about 2 lbs./msf of the coating composition disposed over the first coating weight.

In yet another embodiment, the present invention provides a method of making a substantially titanium dioxide-free coating composition for coating a low brightness substrate, comprising admixing a pigment comprising a major pigment portion of a hydrous kaolin having a TAPPI brightness of at least about 85, and a minor pigment portion of a calcined kaolin with a binder in the substantial absence of titanium dioxide.

In another embodiment, the present invention provides a method of making a reduced titanium dioxide-free coating composition for coating a low brightness substrate, comprising admixing a pigment comprising a major pigment portion of a hydrous kaolin having a TAPPI brightness of at least about 85, and a minor pigment portion comprising a calcined kaolin and titanium dioxide with a binder, wherein the titanium dioxide is less than about 15 dry parts per hundred of the pigment.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE INVENTION

The present invention may be understood more readily by reference to the following detailed description of preferred embodiments of the invention.

Before the present compositions and methods are disclosed and described, it is to be understood that the terminology used herein is for the purpose of describing particular embodiments only and is not intended to be limiting. It must be noted that, as used in the specification and the appended claims, the singular forms "a," "an" and "the" include plural referents unless the context clearly dictates otherwise.

Throughout this application, various publications are referenced. The disclosures of these publications in their entireties are hereby incorporated by reference into this application in order to more fully describe the state of the art to which this invention pertains.

Formulations

A. Prior Art Formulations:

Typical prior art formulations for covering dark paperboard resemble the following:

Industry Standard Coating Formulation for Dark Substrates

| Material | Dry Parts |
|---|---|
| Pigment | |
| # 1 Kaolin | 72 |
| Calcined Kaolin | 6 |
| Titanium Dioxide | 22 |
| Binder* | |
| Latex | 22 |

*Alternatively, the binder can be comprised of approximately 14 pph latex and approximately 6 pph soy protein.

This formulation results in a coated paperboard having a TAPPI brightness of at least about 75, but requires a significant amount of titanium dioxide. Coating weight can be arrived at by assuming that it would require 0.600 lbs./msf of titanium dioxide to cover a dark substrate (i.e., having a TAPPI brightness of below about 50). Then, based upon the Industry Standard Coating Formulation for Dark Substrates set forth in the pending table, the percent of titanium dioxide in the coating is arrived at by dividing the 22 dry parts of titanium dioxide by the 122 total dry parts set forth in the table. The result of this division indicates that the standard coating formulations contains about 18% titanium dioxide. Therefore, the minimum coating weight required for coverage can be computed by dividing the amount of titanium dioxide required to coat the substrate (0.600 lbs./msf) by the percentage of titanium dioxide in the coating formulation (0.18) to arrive at a coating weight of about 3.3 lbs./msf.

B. Formulations of the Present Invention:

The present invention provides a high brightness coating composition which may be used to coat paper, paperboard, or other substrates. Thus, a "substrate" includes any article that is customarily or feasibly could be coated with a coating formulation. This composition is made of a pigment and a binder. As used herein with respect to coated substrates, the phrase "high brightness" refers to an overall TAPPI brightness of the coated substrate of at least 75, preferably at least about 78, more preferably at least about 80. The pigment uses a major pigment portion of a hydrous kaolin having a TAPPI brightness of at least about 85 and a minor portion of a calcined kaolin. As used herein, the term "major portion", e.g., "major pigment portion", refers to an ingredient (or ingredients) of composition which accounts for at least 50% or more of the total composition by weight and comprises of the components listed as comprising the major portion. In addition, as used herein, the term "minor portion", e.g., "minor pigment portion", refers to an ingredient (or ingredients) of a composition which accounts for at most 50% of the total composition by weight and comprises of the components listed as comprising the minor portion. Preferably, the calcined kaolin has a minimum TAPPI brightness of at least 92.5. This paper coating composition is substantially free of titanium dioxide. As used herein, the term "substantially free" means that the overall composition contains less than 1% by weight, more preferably no more than trace amounts, of the specified ingredient.

State of the art chemically structured kaolins do not provide sufficient brightness in the resulting formulation as compared to calcined kaolin. However, it is believed that suitable chemically structured kaolins might be developed in the future and such kaolins would be useful for the present purposes.

In addition to the basic ingredients set forth above, one of ordinary skill in the art would recognize that various additives could be added to the basic formulation of the invention. For instance, cross-linkers could be added to improve wet rub resistance, dyes or pigments could be added to adjust shade, and lubricants could be added to improve gloss.

Typical size or E.S.D. ranges for #1 kaolin vary from 90 to 93% being less than 2 microns. Typical E.S.D. values for calcined kaolin range from 86 to 92% being less than 2 microns. In general, too much uniformity in particle size can reduce flow and cause packing to occur in the coater. Moreover, too much grinding of calcined clay (to reduce viscosity) can destroy some of the beneficial structural features which provide for its superior optical properties. In addition, too large a particle size reduces microsmoothness and, thus, gloss.

In a preferred embodiment, the pigment comprises from about 15 to about 30, preferably from about 18 to about 25, and more preferably from about 20 to about 25, and even more preferably from about 22 to about 25 dry parts per hundred of the calcined kaolin. As used herein, "dry parts" is used to refer to dry parts by weight. As used herein, "dry parts per hundred" of an ingredient refers to the use of the enumerated number of dry parts of the ingredient per one hundred total parts by weight of the composition. The remainder of the pigment comprises hydrous kaolin. As one of ordinary skill in the art would recognize and as used herein, it is customary in this art that the pigment parts add up to 100, independent of the dry part counts for any additional ingredients. Moreover, in another preferred embodiment, the binder comprises about 10 to about 25, more preferably about 15 to about 25, more preferably about 18 to about 20, dry parts of the composition. The binder parts are in addition to the 100 dry parts of pigment in the resulting composition and, therefore, the resulting composition could, for instance, be made up of 115 dry parts, assuming 15 dry parts of binder. In a preferable embodiment, the binder comprises a naturally occurring or synthetic latex (such as styrene butadiene), starch, soy protein, casein or a mixture thereof. However, one of skill in the art would recognize that other binder materials could be used without detracting from the basic nature of the present invention.

It is preferable that the solids content of the composition is at least 60% (solids content is stated as a percentage by weight throughout this specification and the appended claims and refers to the non-aqueous portion of the composition). Rod and blade coating machines are highly sensitive to the solids content of the coating formulation. With these machines, a higher solids content dramatically improves the coating weight and thus the appearance of the coated paper. In addition, at below 60% solids, it is increasingly difficult to apply a sufficient amount of coating, using a rod or blade coater, which is necessary to significantly improve the appearance of the coated paper. One of ordinary skill in the art would recognize that typical hydrous kaolins have a solids content of about 70%, typical calcined kaolins have a solids content of from 60 to about 70%, and typical binders, such as latex binders, have a solids content of about 50%.

However, when using an air knife coater, the solids content of the composition is preferably at least 45%. An air knife coater applies a surplus of coating through an applicator roll and then excess coating is metered off using a narrow jet of high velocity air. An air knife thus provides good appearance because the coating layer follows the contours of the substrate. In normal board coating, titanium dioxide is added only to the air knife coating formulation. However, the present invention permits significant appearance improvements using a rod or blade type precoater. Also, air knifes cannot sufficiently disperse coatings with solids contents over 50% at normal operation conditions and speeds. Finally, because most paper and paperboard mills have limited storage facilities, they will generally use the identical clay system in the precoating as well as the air knife coating steps.

In addition, the use of an air knife is physically limited to speeds of less than 2000 feet per minute for coating weights of up to 2 lbs./msf. In fact, current air knife coaters rarely exceed 1000 feet per minute, with 1800 feet per minute being the industry maximum. On the other hand, a rod coater has no machine speed limitation. In addition, combinations of rods and blades can be used to significantly increase maximum throughput above that of an air knife coater. Thus, while the present invention can be practiced with an air knife coater, in a preferred embodiment, the present invention can be practiced with a rod or blade coater, or combinations thereof.

In an alternative embodiment, the present invention provides a further high brightness coating composition. This composition is again comprised of a pigment and a binder. The pigment comprises of a major pigment portion of a hydrous kaolin having a TAPPI brightness of at least about 85 and a minor pigment portion of both a calcined kaolin and titanium dioxide. In this composition, it is preferable that the titanium dioxide comprises less than about 15, and even more preferably less than 10, dry parts of the pigment; however, at least 1% by weight of titanium dioxide is required for this composition. For the purposes of the present disclosure, less than 1% by weight of titanium dioxide is considered equivalent to the elimination of titanium dioxide from the formulation. Formulations that have eliminated titanium dioxide are described elsewhere herein.

Thus, in a further embodiment of the coating composition, the pigment comprises from about 18 to about 30, preferably from about 18 to about 19 dry parts per hundred of the calcined kaolin, and from about 5 to about 10 dry parts per hundred of the titanium dioxide. The remainder of the 100 pigment dry parts is comprised of the hydrous kaolin. In a further preferable embodiment, the binder comprises an additional 10 to about 25, preferably about 15 to about 25, more preferably about 18 to about 20, dry parts of the composition. In yet another preferable embodiment, the binder comprises of a latex such as styrene butadiene, starch, soy protein, casein or a mixture thereof.

Depending upon the coating apparatus and method, it may be preferable to maintain a solids content in the composition of at least 60%. For other application methods, the solids content of the composition will be at least 45%.

In addition, the present invention provides a coated paper product having a TAPPI brightness of at least about 75, more preferably at least about 78, even more preferably at least about 80. This product is produced by first coating a substrate with a first coating weight of from about 1 to about 5 lbs./msf, preferably from about 2 to about 4 lbs./msf of a coating composition of the invention (titanium dioxide-free or reduced). If necessary, a further coating may be applied to the substrate with a second coating weight of at least about 2 lbs./msf of the coating composition. Preferably, the optional second coating weight is from about 1 to about 5 lbs./msf, preferably from about 2 to about 4 lbs./msf, and more preferably about 3 lbs./msf.

Table 1 details the brightness and appearance results for several coated substrates using the formulations of the present invention.

TABLE 1

| Sample | Base-stock | Base-stock Bright-ness | 1st CWT (lbs./msf) | 2nd CWT (lbs./msf) | Coated Bright-ness | Appear-ance |
|---|---|---|---|---|---|---|
| 1 | liner-board 1 | 18 | 4 | n/a | 74 | Uniform |
| 2 | liner-board 1 | 18 | 4 | 3 | 84 | Excellent |
| 3 | liner-board 2 | 25 | 2 | n/a | 65 | Mottled |
| 4 | liner-board 2 | 25 | 2 | 3 | 80 | Good |
| 5 | recycled F.C. | 35 | 3 | n/a | 72 | Uniform |
| 6 | recycled F.C. | 35 | 3 | 3 | 83 | Excellent |
| 7 | no data | | | | | |
| 8 | no date | | | | | |
| 9 | recycled F.C. | 35 | 3 | n/a | 74 | Uniform |

Recycled folding carton paperboard is considered to be a mid- to high-end paperboard grade substrate. Linerboard is considered to be a low-end paperboard grade substrate and is often rough and non-uniform in appearance.

Samples 1–6 were prepared using a mixture of high brightness kaolin (KAOGLOSS 90, Thiele Kaolin Co., Sandersville, Ga.) and calcined kaolin (KAOCAL, Thiele Kaolin Co., Sandersville, Ga.) at a ratio of 80 parts KAOGLOSS 90 to 20 parts KAOCAL. No data was collected for samples 708. In addition, sample 9, using standard brightness kaolin (KAOGLOSS, Thiele Kaolin Co., Sandersville, Ga.) and KAOCAL in and 80:20 ratio was also prepared and tested. At ratios of approximately 85:15 kaolin:calcined kaolin and above, the formulation is operable but the surprising and synergistic results of the present formulations would be significantly reduced. Moreover, at ratios below approximately 70:30 hydrous kaolin to calcined kaolin, although the properties of the invention would be retained, the cost savings of reducing or eliminating titanium dioxide would be compromised. The physical properties of the tested kaolins are briefly set forth in Table 2.

TABLE 2

| | KAOGLOSS 90 | KAOGLOSS | KAOCAL |
|---|---|---|---|
| G.E. Brightness | 90–92 | 86.5–88.0 | 92.5 (minimum) |
| Particle size, % less than 2 microns | 90–93 | 90–93 | 86–92 |

As can be seen, Samples 2, 4, and 6 all exhibited superior brightness characteristics, even when coating low brightness base stock and in the absence of titanium dioxide. Moreover, the absence of titanium dioxide provides for less abrasive coating formulations, thereby extending the useful life of coating metering devices such as wire wound rods from several hours to over one day or more. In addition, Samples 1, 5 and 9 demonstrate the superior results that are possible even with only a single coating operation.

Methods:

The coating formulations described above can be applied in the following manner.

Paper and paperboard coaters are comprised of three elements: the coating applications system, the coating metering system, and the coating drying system. In a typical coating process, the substrate passes through the applicator where an excess of a coating formulation is applied to its surface (generally the lower surface). The metering device then meters off the excess coating material. Finally, the drying system dries the coating. Standard drying systems use hot air impingement drying. However, gas fired infrared drying is also used.

As described elsewhere, the formulations of the present invention can be applied using blade coaters, bar or rod coaters or air knife coaters.

For use with a rod (bar) or blade coater, the solids content is between 61 and 65% to maximize the structuring properties of the coating formulations of the present invention. For use with an air knife coater, the solids content is adjusted down to about 45 to 50% to accommodate the limitations of such coaters. Nonetheless, for either type of coater, the optical properties of the coated paperboard comprising a substrate coated using the method of the invention in conjunction with the formulations of the invention is superior.

Coating weights ("CWT") of about 4 lbs. per 1000 square feet (lbs./msf) for rod or blade coatings and about 3 lbs./msf for air knife coatings yield coatings with appearance equivalent to those produced using industry standard amounts of titanium dioxide.

Therefore, in addition to the above-described compositions, the present invention also provides a method of using a coating composition to coat a low brightness substrate, whereby the resultant coated substrate has a TAPPI brightness of at least about 75. This method comprises first coating the substrate with a first coating weight of from about 1 to about 5 lbs./msf of one of the above-described coating compositions of the invention. Depending upon the desired brightness level, it may be necessary, in a second coating step, to coat further the substrate with a second coating weight of at least about 2 lbs./msf of the coating composition. These methods may be practiced with either the titanium dioxide free formulations or the reduced titanium dioxide formulations of the present invention.

Moreover, the present invention also provides a method of making a substantially titanium dioxide-free coating composition for coating a low brightness substrate. This method involves admixing a pigment comprising a major pigment portion of a hydrous kaolin having a TAPPI brightness of at least about 85, and a minor pigment portion of a calcined kaolin with a binder, in the substantial absence of titanium dioxide. As used herein, "substantial absence" means that the composition be substantially free, i.e., less than 1% by weight, of the specified ingredient.

In addition, the present invention also provides a method of making a reduced titanium dioxide-free coating composition for coating a low brightness substrate, comprising admixing a pigment comprising a major pigment portion of a hydrous kaolin having a TAPPI brightness of at least about 85, and a minor pigment portion comprising a calcined kaolin and titanium dioxide with a binder, wherein the titanium dioxide comprises less than about 15, more preferably less than about 10, dry parts per hundred of the pigment.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A coating composition having a solids content, comprising:

a) a pigment comprising:

i) a major portion of a hydrous kaolin having a TAPPI brightness of at least about 85; and ii) a minor portion of a calcined kaolin; and b) a binder, wherein the pigment is substantially free of titanium dioxide.

2. The composition of claim 1, wherein the pigment comprises at least about 15 dry parts of the calcined kaolin per hundred parts.

3. The composition of claim 1, wherein the binder comprises about 10 to about 25 dry parts of the composition.

4. The composition of claim 1, wherein the binder comprises a latex, starch, soy protein, casein or a mixture thereof.

5. The composition of claim 1, wherein the solids content of the composition is at least 60% by weight.

6. The composition of claim 1, wherein the solids content of the composition is at least 45% by weight.

7. A coating composition having a solids content, comprising:

a) a pigment comprising:

i) a major portion of a hydrous kaolin having a TAPPI brightness of at least about 85; and ii) a minor portion comprising:

1) a calcined kaolin; and 2) titanium dioxide; and b) a binder, wherein the titanium dioxide is less than about 15 dry parts per hundred of the pigment.

8. The composition of claim 7, wherein the pigment comprises at least about 18 dry parts per hundred of the calcined kaolin, at least about 5 to about 10 dry parts per hundred of the titanium dioxide, with the remainder of the pigment comprised of the hydrous kaolin.

9. The composition of claim 7, wherein the binder comprises about 10 to about 25 dry parts of the composition.

10. The composition of claim 7, wherein the binder comprises a latex, starch, soy protein, casein or a mixture thereof.

11. The composition of claim 7, wherein the solids content of the composition is at least 60% by weight.

12. The composition of claim 7, wherein the solids content of the composition is at least 45% by weight.

13. A method of using a coating composition to coat a substrate, whereby the resultant coated substrate has a TAPPI brightness of at least about 75, the method comprising coating the substrate with a first coating weight of from about 1 to about 5 lbs./msf of a coating composition having a solid content comprising:

a) a pigment comprising a major portion of a hydrous kaolin having a TAPPI brightness of at least about 85, and a minor portion of a calcined kaolin; and b) a binder, wherein the pigment is substantially free of titanium dioxide, to thereby obtain a coated substrate having a TAPPI brightness of at least about 75.

14. The method of claim 13, further comprising coating the substrate with a second coating weight of at least about 2 lbs./msf of the coating composition.

15. The method of claim 13, wherein the pigment comprises at least about 15 dry parts of the calcined kaolin per hundred parts.

16. The method of claim 13, wherein the binder comprises about 10 to about 25 dry parts of the composition.

17. The method of claim 13, wherein the binder comprises a latex, starch, soy protein, casein or a mixture thereof.

18. The method of claim 13, wherein the solids content of the composition is at least 60% by weight.

19. The method of claim 13, wherein the solids content of the composition is at least 45% by weight.

20. A method of using a coating composition to coat a substrate, whereby the resultant coated substrate has a TAPPI brightness of at least about 75, the method comprising coating the substrate with a first coating weight of from about 1 to about 5 lbs./msf of a coating composition having a solids content comprising:

a) a pigment comprising a major portion of a hydrous kaolin having a TAPPI brightness of at least about 85, and a minor portion comprising a calcined kaolin and titanium dioxide; and b) a binder, wherein the titanium dioxide is less than about 15 dry parts per hundred of the pigment, to thereby obtain a coated substrate having a TAPPI brightness of at least about 75.

21. The method of claim 20 further comprising coating the substrate with a second coating weight of at least about 2 lbs./msf of the coating composition.

22. The method of claim 20, wherein the pigment comprises at least about 18 dry parts per hundred of the calcined kaolin, at least about 5 to about 10 dry parts per hundred of the titanium dioxide, with the remainder of the pigment comprised of the hydrous kaolin.

23. The method of claim 20, wherein the binder comprises about 10 to about 25 dry parts of the composition.

24. The method of claim 20, wherein the binder comprises a latex, starch, soy protein, casein or a mixture thereof.

25. The method of claim 20, wherein the solids content of the composition is at least 60% by weight.

26. The method of claim 20, wherein the solids content of the composition is at least 45% by weight.

27. A coated paper product having a TAPPI brightness of at least about 75 comprising a substrate coated with a first coating weight of from about 1 to about 5 lbs./msf of a coating composition having a solids content comprising:

a) a pigment comprising a major portion of a hydrous kaolin having a TAPPI brightness of at least about 85, and a minor portion of a calcined kaolin; and b) a binder, wherein the pigment is substantially free of titanium dioxide.

28. The coated paper product of claim 27, wherein the coated paper product comprises a second coating weight of at least about 2 lbs./msf of the coating composition disposed over the first coating weight.

29. The product of claim 27, wherein the pigment comprises at least about 15 dry parts of the calcined kaolin per hundred parts.

30. The product of claim 27, wherein the binder comprises about 10 to about 25 dry parts of the composition.

31. The product of claim 27, wherein the binder comprises a latex, starch, soy protein, casein or a mixture thereof.

32. The product of claim 27, wherein the solids content of the composition is at least 60% by weight.

33. The product of claim 27, wherein the solids content of the composition is at least 45% by weight.

34. A coated paper product having a TAPPI brightness of at least about 75 comprising a substrate coated with a first coating weight of from about 1 to about 5 lbs./msf of a coating composition having a solids content comprising a) a pigment comprising a major portion of a hydrous kaolin having a TAPPI brightness of at least about 85, and a minor portion comprising a calcined kaolin and titanium dioxide; and b) a binder, wherein the titanium dioxide is less than about 15 dry parts per hundred of the pigment.

35. The product of claim 34, wherein the coated paper product further comprises coating a second coating weight of at least about 2 lbs./msf of the coating composition disposed over the first coating weight.

36. The product of claim 34, wherein the pigment comprises at least about 18 dry parts per hundred of the calcined kaolin, at least about 5 to about 10 dry parts per hundred of the titanium dioxide, with the remainder of the pigment comprised of the hydrous kaolin.

37. The product of claim 34, wherein the binder comprises about 10 to about 25 dry parts of the composition.

38. The product of claim 34, wherein the binder comprises a latex, starch, soy protein, casein or a mixture thereof.

39. The product of claim 34, wherein the solids content of the composition is at least 60% by weight.

40. The product of claim 34, wherein the solids content of the composition is at least 45% by weight.

* * * * *